US005512058A

United States Patent [19]

Gavend et al.

[11] Patent Number: 5,512,058

[45] Date of Patent: Apr. 30, 1996

[54] PROCESS FOR THE TREATMENT OF SKINS, HIDES OR SHETT MATERIALS CONTAINING COLLAGEN BY A DENSE, PRESSURIZED FLUID

[75] Inventors: Gérard Gavend; Bernard Vulliermet, both of Lyon, France; Christian Perre; Maurice Carles, both of Pierrelatte, all of France

[73] Assignees: Commissariat l'Energie Atomique, Paris, France; Centre Technique Cuir-Chaussure-Maroquinerie, Lyon, France

[21] Appl. No.: 244,206

[22] PCT Filed: Oct. 1, 1993

[86] PCT No.: PCT/FR93/00960

§ 371 Date: Jun. 2, 1994

§ 102(e) Date: Jun. 2, 1994

[87] PCT Pub. No.: WO94/08054

PCT Pub. Date: Apr. 14, 1994

[30] Foreign Application Priority Data

Oct. 2, 1992 [FR] France ..... 92 11703

[51] Int. Cl.[6] ..... C14C 1/08; C14C 03/00; C14C 9/00

[52] U.S. Cl. ..... 8/94.18; 8/94.15; 8/94.2; 8/94.21; 8/94.24; 8/94.25; 8/94.26; 8/94.27; 8/94.28; 8/94.29; 8/94.31; 8/94.32; 8/94.33

[58] Field of Search ..... 8/94.15, 94.18, 8/94.2, 94.21, 94.24, 94.25, 94.29, 94.31, 94.32, 94.33, 94.26, 94.27, 94.28; 427/389

[56] References Cited

U.S. PATENT DOCUMENTS 4,776,173 10/1988 Kamarei et al. ..... 62/63
5,169,687 12/1992 Sunol ..... 427/297

*Primary Examiner*—Stephen Kalafut
*Assistant Examiner*—Alan D. Diamond
*Attorney, Agent, or Firm*—Oblon, Spivak, McClelland, Maier & Neustadt

[57] ABSTRACT

A process for the treatment of products constituted by hides and skins with a view towards their transformation into leather, and for the treatment of leather which involves contacting the product with a dense, pressurized fluid, such as $CO_2$, in the supercritical state or pressurized liquid, which optionally contains one or more active substances and a specified pressure Pi and temperature Ti, in order to provide degreasing of the skins if pure dense fluid is used, or to impregnate the products with active substances such as tanning, stiffening, dyeing or waterproofing agents. The products are subsesquently brought to atmospheric pressure to eliminate the dense fluid therefrom.

26 Claims, 1 Drawing Sheet

PROCESS FOR THE TREATMENT OF SKINS, HIDES OR SHETT MATERIALS CONTAINING COLLAGEN BY A DENSE, PRESSURIZED FLUID

The present invention relates to a process for the treatment of hides, skins or other sheet materials containing collagen, during different stages of the transformation of the skins into leather and different stages of the finishing of said products.

The different stages of the transformation of skins and hides into leather are in particular degreasing, which consists of removing part of the greases from the skin in order to facilitate its transformation into leather and tanning, which transforms the raw, putrescible skin into strong, imputrescible leather. The last mentioned operation is considered to be the most important in the transformation chain of skins into leathers.

The different finishing stages can consist of retanning, which is an operation of reinforcing the mechanical behaviour of leathers, dyeing and waterproofing.

In existing skin and hide treatment processes, these different treatment stages use liquid solvents or aqueous solutions containing active principles, which leads to a large amount of environmentally prejudicial effluents. Moreover, the standards for using liquid solvents are becoming increasingly severe and some of them will be forbidden in the near future.

For example, the quantity of mainly aqueous effluents discharged at present by the leather industry throughout the world is approximately 400 g to 500 million $m^3$ per year, i.e. close to 40 million "daily inhabitant" equivalents.

The present invention is directed at a process for the treatment of skins, hides or sheet materials containing collagen, which makes it possible to avoid the use of noxious solvents which are prejudicial to the environment and to significantly limit the volumes of effluent produced during said treatments.

The process according to the invention is more particularly applicable to the degreasing and tanning of skins and to the finishing treatments (retanning, reinforcement of the structure, dyeing and waterproofing) of skins, hides and other sheet materials containing collagen.

Thus, the invention relates to a process for the degreasing of skins with a view to the transformation thereof into leather and comprising the following stages:

a) contacting the skins with a dense fluid able to dissolve grease, under a pressure Pi and a temperature Ti, the pressure Pi being at least equal to the critical pressure Pc of the fluid and the temperature Ti being such that the fluid has an adequate density to ensure the partial solubilization of the grease and b) returning the skins to atmospheric pressure in order to eliminate the dense fluid in gaseous form.

Advantageously, in stage a) of said process, there is a continuous circulation of the dense fluid at the pressure Pi and the temperature Ti in a treatment enclosure containing the skins, the dense fluid is purified on leaving the treatment enclosure in order to separate therefrom the dissolved grease and the purified, dense fluid is recycled to the enclosure entrance.

The purification of the dense fluid can take place by varying its pressure and/or its temperature in order to eliminate the dissolved products in liquid form. In order to recycle the dense fluid, it is then necessary to bring it to chosen pressure conditions Pi and temperature conditions Ti.

In stage b), the circulation of the dense, pressurized fluid is interrupted and the enclosure is brought to atmospheric pressure.

In this process, the dense, pressurized fluid is used as the solvent for extracting lipidic grease, but working takes place in such a way that there is not a total grease extraction so as to ensure that the skin retains a supple or flexible appearance.

The use of a dense, pressurized fluid makes it possible to obtain this partial grease extraction, because the solvent and alehydrating properties of the dense fluid can be carefully modified by regulating the pressure Pi and the temperature Ti so as to adjust the density of the dense fluid and obtain the desired skin dilipidation level.

Therefore the process according to the invention makes it possible to perform the degreasing of the skins under good conditions.

The invention also relates to a process for the treatment of products constituted by skins, hides or sheet materials containing collagen with a view to their transformation into leather or their finishing and which comprises the following stages:

a) contacting the skins, hides or sheet materials with a dense fluid containing at least one active substance for the transformation or finishing of the skins, hides or sheet materials, under a pressure Pi at least equal to the critical pressure Pc of the fluid and a temperature Ti such that the fluid has an adequate density for impregnating the skins, hides or sheet materials with the active substance or substances and b) returning the skins, hides or sheet materials to atmospheric pressure in order to eliminate the dense fluid in gaseous form.

In this treatment process, advantageously stage a) is performed by continuously circulating the dense fluid containing the active substance or substances at the pressure Pi and the temperature Ti in a treatment enclosure containing the skins, hides or sheet materials, by treating the dense fluid on leaving the treatment enclosure in order to readjust to the desired value its content of active substance or substances and by recycling the thus treated, dense fluid in the treatment enclosure.

The treatment of the dense fluid leaving the enclosure with a view to readjusting its content of active substance or substances to the desired value can be performed in gas-liquid or liquid-liquid contactors such as countercurrent exchange columns.

Stage b) can be performed as hereinbefore by interrupting the flow of dense fluid in the enclosure and returning the latter to atmospheric pressure.

In certain cases, it may of interest to rinse the products treated in the enclosure by a pure, dense fluid before carrying out the stage a) of impregnation by the active substance and/or before the decompression stage b).

Moreover, as a function of the nature of the active substance, the stage a) can be performed in a static manner (soaking) or a dynamic manner, i.e. with a continuous flow of dense fluid containing the active substance.

According to the invention, the term dense fluid is understood to mean a fluid under a pressure P higher than the critical pressure Pc of said fluid, which is preferably under temperature conditions Ti close to the critical temperature Tc of the fluid, said temperature and said pressure being chosen so as to give the fluid, either a high grease extracting power, or a high dissolving or transporting power with respect to the active substance or substances used.

Advantageously, the dense fluid used is in the form of a gas at ambient temperature and pressure.

This dense fluid can e.g. be chosen from among carbon dioxide, sulphur hexafluoride, nitrous oxide, ammonia and light alkanes, e.g. having 2 to 5 carbon atoms. Preference is given to the use of carbon dioxide, because it is not toxic, non-flammable, only slightly reactive and not onerous.

Moreover, these supercritical conditions are very accessible because its critical temperature and pressure are respectively 31° C. and 7.3 mPa.

According to the invention, the dense fluid can be in the subcritical or supercritical state.

The term subcritical fluid is understood to mean a fluid at a temperature T below the critical temperature Tc of the fluid, which in the process of the invention corresponds to the liquid state, because the pressure Pi of the fluid is always above the critical pressure Pc.

The term supercritical fluid is understood to mean a fluid, whose temperature T exceeds the critical temperature, which in the process of the invention corresponds to the supercritical state because the pressure Pi of the fluid is always above the critical pressure.

The attached FIG. 1 is the state diagram (in mixed lines) of the pressure in mPa and the temperature in ° C. of carbon dioxide $CO_2$. Thus, the critical point C of $CO_2$ corresponds to a critical temperature Tc of 31° C. and a critical pressure Pc of 7.3 mPa. The supercritical fluid in the supercritical state according to the invention corresponds to the hatched area A. The subcritical fluid in the liquid state according to the invention corresponds to the hatched area B.

As a function of the pressure and temperature conditions chosen in the areas A and B, it is possible to regulate the density of the fluid and therefore its solvent power with respect to the grease to be dissolved or its dissolving and transportability capacity for the active substances used, by also optimizing its dissolving capacity so that it is not prejudicial with respect to the products to be treated.

In FIG. 1 are shown in broken line form the volume isomass lines (in $kg/cm^3$) of $CO_2$.

Thus, in the case of carbon dioxide, the densities obtained under pressure are around 1 $kg/cm^3$ for the liquid state and modifiable from 0.2 to 1 $kg/cm^3$ for the supercritical state giving a solvent power equivalent to that of conventional liquid solvents for the most dense states. Moreover, as this solvent power can be modified by the pressure and/or temperature, it can be appropriately used in the purification and impregnation operations using the active substance or substances during the recycling of the dense fluid.

Preferably, according to the invention, use is made of a dense fluid in the supercritical state. In this state, the dense fluid also has viscosities which are 10 times lower and diffusion coefficients which are 10 to 100 times higher than in the liquid state, which is an important advantage for the extraction kinetics and for the impregnation operations.

According to the invention, the pressure Pi can be chosen e.g. in the range 6 to 50 mPa and the temperature Ti e.g. between 10° and 300° C.

In certain cases, it is also possible to improve the diffusion of the dense fluid into the products to be treated by periodically varying the pressure of the dense fluid $\Delta P$ around Pi. The pressure variation $\Delta P$ can represent approximately 10% of Pi, e.g. over a period of 5 to 50s.

When the process according to the invention is performed for carrying out treatments for transforming skins into leather or finishing treatments, the active substances used are chosen as a function of the sought aim.

Generally, these active substances are organic materials or organo-mineral complexes and the dense fluid used is also chosen as a function of the active substance, so as to dissolve said substance or so as to be able to ensure its transfer to the products to be treated in the enclosure.

In the transformation of skins into leather or in modifications of the appearance of the leathers having a natural origin or sheet materials containing collagen, the most important impregnating operations are lining or reinforcement by tanning and/or retanning, dyeing and waterproofing.

The active substance is advantageously chosen from among tanning agents, reinforcing or stiffening agents, dyeing agents, waterproofing agents and precursors of said agents.

In exemplified manner, the tanning or reinforcing agents can be aldehyde compounds such as formaldehyde and glutaraldehyde; condensation products of the acrylate-diisocyanate, methylol-urea or methylol-melamine types, of the telechelic oligomer type, or precursors or these products, e.g. polyethylene glycols (PEG) and polytetraethylene glycols (PTEG) or methylene glycols (PTMG) modified in the case of telechelic oligomers; products based on phenol, naphthol, naphthalene or dihydroxyphenyl sulphone; plant or vegetable tannins e.g. having a pyrogallic or catechic base or their precursors, chromium, aluminium, zirconium, titanium and iron tannins.

Examples of dyeing or colouring agents which can be used are nitro and nitroso compounds, such as monoazo and polyazo dyes and metal complexes; stilbene derivatives; diphenyl and triphenyl methane derivatives; oxazine, thiazine and azine compounds; pyridine, quinoline and acridine; phthalocyanin compounds; anthraquinone compounds, sulphur dyes; and their precursors.

Examples of waterproofing agents usable in the invention are chromium complexes and fluorine fatty acids, chromium and aluminium alkyl phosphates, imidoacetic acid derivatives, phosphoric acid esters, polysiloxane resins, fluorocarbon compounds or their precursors.

According to the invention, the dense fluid can also comprise an additive for modifying the solvent or dehydrating power of the dense fluid, or for facilitating the dissolving or transfer of the active substance or substances into the dense fluid.

Thus, when the active substance is not directly soluble in the dense fluid used, it can be dissolved in an additive serving as an auxiliary solvent, everything being soluble or transferred into the dense fluid.

Examples of additives which can be used are water and alcohols such as ethanol, methanol, isopropyl alcohol, etc.

When use is made of such an additive serving as an auxiliary solvent, it is no longer possible to speak of direct solubility of the active substance in the dense fluid. Reference must then be made to indirect solubility or transportability of the active substance and its solvent by the dense, pressurized fluid. Thus, the solvent contains the active substance and the mixture is dissolved or transported by the dense, pressurized fluid.

In this case, the use of the dense, pressurized fluid makes it possible to significantly reduce the liquid solvent quantity in contact with the treated products.

The additive used can also be water, which makes it possible to modify the drying power of the dense fluid. This possibility of regulating the water content of the treated products by modifying the drying power of the dense fluid represents a significant improvement to the chain of transforming skins into leathers.

In the process according to the invention, the active substance or substances can be included in the treated products, either by capillarity or direct absorption in these products when the latter have a particular affinity for the active substance, or by the reaction of the active substance with compounds of the treated product, or by means of an appropriate treatment transforming the active substance into a form retained by the product to be treated. In this case, the active substance can be constituted by a precursor of a tanning, reinforcing, dyeing or waterproofing agent.

The treatments able to modify the active substance so that it is retained in the treated product can consist of a chemical, physicochemical or photochemical treatment, an irradiation, or even a heat treatment. These treatments can be performed during or after the contacting of the products with the dense fluid.

The process according to the invention is of great interest for the treatment of skins, hides and other sheet products containing collagen, because it can be performed at different stages of the transformation and finishing chain of these products. When the process according to the invention is used in different stages of this chain, in each stage pressure and temperature conditions adapted to the treatment performed are use and these conditions can be identical or different on passing from one treatment stage to another. Moreover, it is possible to use the same dense fluid in all the stages or different dense fluids.

BRIEF DESCRIPTION OF THE FIGURES

Other features and advantages of the invention can be better gathered from reading the following, non-limitative description with reference to the attached drawings, wherein show:

FIG. 2 shows that the installation comprises a treatment enclosure (1) in which can be placed the products (2) to be treated such as skins, hides or sheet products containing collagen, using an appropriate support for assisting the passage of the dense fluid into the products The dense fluid is introduced into the enclosure (1) by an intake duct (3) coming from a storage container (4) after having been brought to the desired pressure Pi by the compressor (5) and the desired temperature Ti by the heat exchanger (7). To the said dense fluid may have been added active substance or substances and/or additives in contactors such as the contactors (9) and (11).

Figure 1:
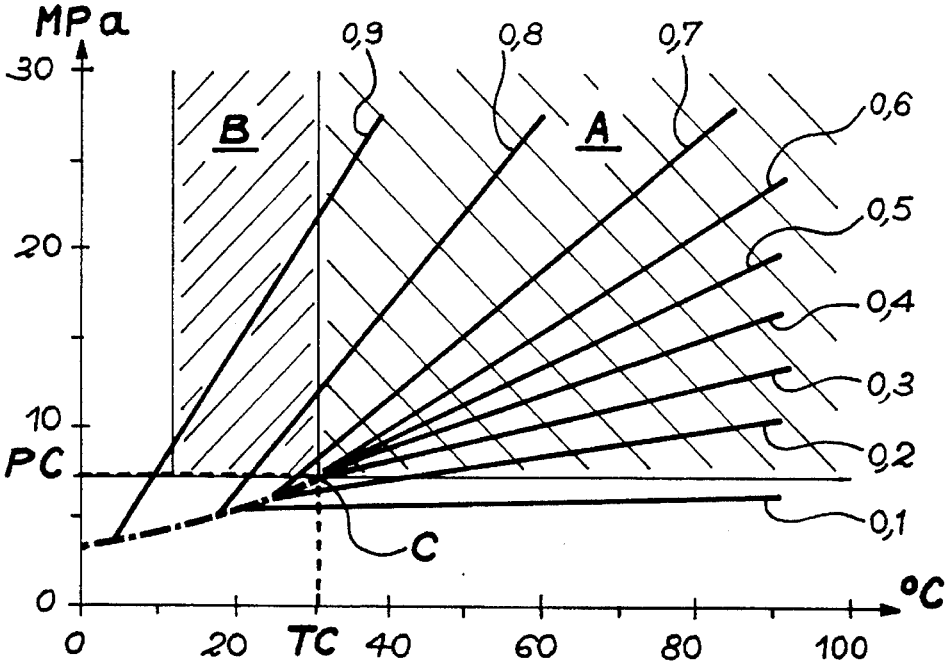
FIG. 1 Already described, in mixed line form the state diagram of $CO_2$ and in continuous line form the volume isomass lines of $CO_2$.
Figure 2:
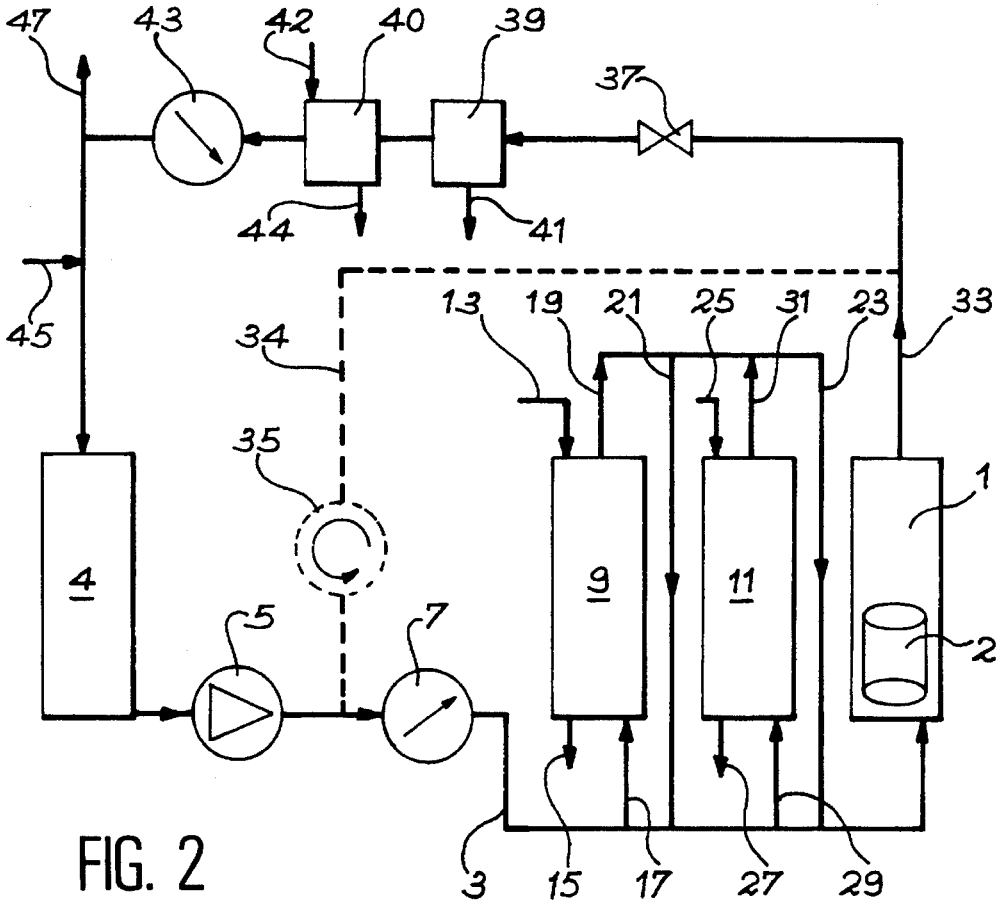
FIG. 2 A treatment installation for performing the process according to the invention.

The contactor (9) in which e.g. circulates water or an additive such as alcohol by means of pipes (13) and (15) can be connected by the pipe (17) to the intake duct (3) for introducing the dense fluid into the enclosure (1). In the contactor (9), the dense fluid introduced by the pipe (17) is discharged by the pipe (19) and then recycled to the intake duct (3), either by the pipe (21), or by the pipe (23). The pipes (17, 19, 21 and 23) and the duct (3) are equipped with not shown, appropriate valves, in order to enable the dense fluid to follow the desired circuit before it enters the enclosure (1).

In the same way, the contactor (11), which is e.g. traversed by an active substance introduced by a pipe (25) and discharged by a pipe (27), can be connected to the intake duct (3) by a pipe (29). The dense fluid containing the active substance leaving the contactor (11) by the pipe (31) is then recycled in the intake duct (3) by the pipe (23). As hereinbefore, the pipes (29) and (31) have appropriate valves.

On leaving the enclosure (1), the dense fluid discharged into the outlet duct (33) can be recycled without pressure drop other than that at the entrance to the enclosure (1) by the pipe (34), the circulator (35), the heat exchanger (7) and optionally the contactors (9) and (11).

However, when the treatment performed in the enclosure is a degreasing treatment, the dense fluid is preferably recycled to the enclosure after having purified the dissolved products contained therein.

To this end, the dense fluid leaving by the duct (33) is expanded in the valve (37) and then introduced into the enclosure (39) for the recovery of dissolved products which are separated from the dense fluid and discharged by the duct (41). Following said separation, the dense fluid in the gaseous state is restored to the appropriate temperature for recycling by the exchanger (43) and passed into the storage container (4) for recycling to the enclosure (1) at the desired temperature and pressure.

In the case of a degreasing treatment, the contactors (9) and (11) are not connected to the supply duct (3).

In the case of other treatments e.g. using wet $CO_2$ with a low water content, it may be advantageous to also recycle the dense fluid by means of the storage tank (4). In this case, it is possible to replace the contactor (9) by a contactor (40) supplied with an additive by the pipes (42 and 44), which is located on the dense fluid recycling circuit. Thus, it is possible to add small quantities of an additive, e.g. water, to the fluid, when in the gaseous state following expansion in the valve (37).

At the end of the treatment, the compressor (5) is stopped and the dense fluid passing out of the enclosure (1) is decompressed by the expansion valve (37) in order to discharge it in gaseous form into the storage container (4) and return the treated products to atmospheric pressure.

When it is wished to vary the treatment pressure around Pi, this is brought about by an appropriate regulation of the circulator (35) or the valve (37) in order to have pulsating treatment conditions.

Finally, the installation can be supplied with treatment fluid by the pipe (45) and emptied by the pipe (47).

The following examples serve: to illustrate the invention.

EXAMPLE 1

Degreasing Sheepskins in the Pickled State.

In this example there are 1.2 kg of whole pickled sheepskins wound around a shaft in the treatment enclosure (1) and the degreasing operation is carried out by the circulation in the enclosure of dry, pure carbon dioxide in the supercritical state, under a pressure of 30 mPa and a temperature of 40° C. The treatment takes place during a time such that use is made of 300 kg of carbon dioxide for the treated 1.2 kg of skins.

At the end of operation, the content of lipids and water in the treated skins is determined. Thus, it is found that the lipid content has dropped by 40% and the water content by 17%.

The skins retain an attractive flexible appearance with a few small deposits of mineral salts.

EXAMPLE 2

Degreasing Skins in the Wet Stabilized White State (WSW)

In this example there are 1.5 kg of WSW whole skins wound around a shaft in the treatment enclosure (1) and the degreasing operation takes place by means of dry, pure $CO_2$ in the supercritical state, under a pressure of 30 mPa and a temperature of 60° C., for a time such that the $CO_2$ quantity used is 300 kg.

At the end of the operation, the lipid and water content of the skins is determined. It is found that the lipid content has dropped by 26% and the water content by 21%.

The skins retain an attractive flexible appearance with a very slight mineral salt deposit.

On comparing the results of these two examples, it can be noted that the degreasing is more effective on the pickled skins than on the WSW skins, the grease content being virtually identical in both cases at the outset. It is assumed that this is due to the different water content of the skins. The water loss is greater on the WSW skins.

The skins or hides treated in examples 1 and 2 were transformed into finished leather and were compared with skins which underwent the same treatments, but for which degreasing was carried out in conventional manner in tawing by using white spirit associated with an emulsifying agent constituted by an alkyl-oxyethylene base.

The skins degreased in the conventional manner or in accordance with examples 1 and 2 were tanned with chromium salt (10% basic sulphate at 33% basicity), then dried, brought to the appropriate thickness by buffing, followed by retanning, dyeing and tawing under the same conditions. During these operations, all the skins were treated in the same equipment in a single batch.

After drying, currying and finishing, no significant differences were found with respect to the flexibility, the fineness of the grain, the hair side and the touch.

The colours are identical and no stain linked with the presence of an excess of fatty material was observed.

EXAMPLES 3 TO 6

Impregnation of the Skins and Hides.

In these examples use was made of the process according to the invention for impregnating skins and hides using as the active substance reinforcing agents constituted by telechelic oligomers of the polyethylene glycol (PEG) type with molecular weights in the range 200 to 1500. The use of these oligomers is of interest, because they are liquid products, which can be dissolved in a dense, pressurized fluid, unlike the solid high polymers generally used for reinforcing leather products.

In these examples, the pressure Pi and temperature Ti conditions were chosen so as to have a good solubility of the active substance (PEG) in the dense fluid constituted by carbon dioxide.

The oligomers used and the pressure and temperature conditions, as well as the solubility of the oligomer in the dense, pressurized fluid are given in the following table 1.

In each example, the skins and hides were impregnated under satisfactory conditions for obtaining their reinforcement by using 300 kg of oligomer-containing, dense fluid per kg of treated products.

EXAMPLES 7 TO 9

Impregnation of Skins and Hides

In these examples, the same operating procedure as in examples 3 to 6 was used for impregnating skins and hides, but the reinforcing product used was constituted by products marketed under the name Terathanes, which are oligomers of the PTEG or PTMG type, precursors of polyurethanes.

As in the case of polyethylene glycols, these oligomers are liquid products, which are more easily solubilized in the dense fluid than the conventionally used solid high polymers.

The pressure and temperature conditions used in these examples, as well as the nature of the oligomer used and its solubility are given in the following table 1.

As hereinbefore, the impregnation operation was performed with 300 kg of supercritical carbon dioxide for 1 kg of treated product, satisfactory results being obtained.

It should be noted that the solubility values given in table 1 are not the maximum solubility values of the products in question.

TABLE 1

| Ex. | Oligomer | Molecular weight | Pi (mPa) | Ti (°C.) | Solubility (g/kg of $CO_2$) |
|---|---|---|---|---|---|
| 3 | polyethylene glycol | 200–600 | 35 | 60 | 3 to 3.5 |
| 4 | " | 1000 | 30 | 60 | 0.7 |
| 5 | " | 1000 | 35 | 60 | 1.2 |
| 6 | " | 1500 | 30 | 60 | 0.4 |
| 7 | Terathane (TER) | 1000 | 30 | 60 | 0.6 |
| 8 | " | 2000 | 30 | 60 | 0.15 |
| 9 | Mixture of TER 1000 + TER 2000 (50/50 by weight) | 1000 2000 | 35 | 60 | 0.45 |

The following examples 10 to 13 illustrate the impregnation of an active substance constituted by a tawing principle in skins and hides.

EXAMPLE 10

In this example, the skins and hides are treated using as the tawing product a sulphited animal oil with a 60% active matter content marketed under the name Lipoderm-Licker PK.

To this end, into the treatment enclosure containing the skins and hides, as well as the oil, is introduced carbon dioxide gas under a pressure of 25 mPa, at a temperature of 40° C. and static operating conditions were used for 16 hours. The skins and hides were then restored to atmospheric pressure and their fat matter content was determined.

The results obtained are given in the following table 2. There is no deterioration to the appearance of the leather.

EXAMPLE 11

The skins and hides were treated using as the active substance the same tawing product as in example 10, but in this case carrying out the impregnation under dynamic conditions in the following way.

Carbon dioxide gas under a pressure of 25 mPa, at a temperature of 40° C. and at a flow rate of 15 kg/h is passed into a first autoclave containing the oil and then into the treatment enclosure containing the skins and hides, for 4 hours.

After this treatment, the tat matter content of the skins and hides is determined. The results obtained are given in table 2. These results make it clear that despite the greater $CO_2$ and oil flows than in example 10, the fat matter content is essentially the same.

EXAMPLE 12

The skins and hides are treated using the same active substance as in examples 10 and 11, using dynamic operating conditions as in example 11, but performing the two following stages under the same pressure (25 mPa), temperature (40° C.) and flow rate (15 kg/h) conditions for the $CO_2$:

1) prior treatment by pure $CO_2$ of the skins and hides for 5 h and
2) impregnation by oil-containing $CO_2$ for 4 h, as in example 11.

The results obtained are given in table 2. Thus, the performance of the two stages makes it possible to improve the fat content of the leathers.

EXAMPLE 13

The skins and hides are treated using as the active substance the same tawing product as in example 11, but in this case impregnation is carried out under pulsating dynamic conditions by circulating $CO_2$ in a first autoclave containing the oil and then into the treatment enclosure containing the skins and hides, under the same temperature (40° C.) and flow rate (15 kg/h) conditions as in example 11, but by sinusoidally varying the pressure at a frequency of 10 s by 1 mPa around the mean value of 19 mPa.

The results obtained under these conditions after 5 h treatment are given in table 2.

Thus, the pulsating operating conditions are beneficial for impregnation.

Despite an 18 to 16% lowering of the water content of the leathers, no deterioration phenomenon (binding in boards, dulling the hair side, etc.) was observed after testing. The moisture variation of the leathers can be limited by a prior humidification of the $CO_2$. However, the water can modify the impregnation mechanisms and can therefore have both a positive and negative effect.

TABLE 2

| Ex. | Active substance | Pi (mPa) | Ti (°C.) | $CO_2$ flow rate in kg/h | Time in h | Fat content (wt. % fat) Before testing | After testing |
|---|---|---|---|---|---|---|---|
| 10 | Lipoderm-licker PK | 25 | 40 | 0 | 16 | 1.1 | 1.3 |
| 11 | Lipoderm-licker PK | 25 | 40 | 15 | 4 | 1.3 | 1.5 |
| 12 | Lipoderm-licker PK | 25 | 40 | 15 | 4 | 1.3 | 1.8 |
| 13 | Lipoderm-licker PK | 19 ± 1 | 40 | 15 | 5 | 0.7 | 1.6 |

We claim:

1. Process for the degreasing of skins with a view to their transformation into leather, characterized in that it comprises the following stages:

a) contacting the skins with a dense fluid able to dissolve grease, under a pressure Pi and a temperature Ti, the pressure Pi being at least equal to the critical pressure Pc of the fluid and the temperature Ti being such that the fluid has an adequate density for ensuring the partial solubilization of the grease and b) returning the skins to atmospheric pressure in order to eliminate the dense fluid in gaseous form.

2. Process according to claim 1, characterized in that in stage a), there is a continuous circulation of the dense fluid at the pressure Pi and the temperature Ti in a treatment enclosure containing the skins, the dense fluid is purified on leaving the treatment enclosure in order to separate therefrom dissolved substances and the purified, dense fluid is recycled to the enclosure entrance.

3. Process according to claim 1 characterized in that the dense fluid also comprises an additive for modifying the solvent or dehydrating power of the dense fluid, or for facilitating the dissolving or transfer of the active substance or substances into the dense fluid.

4. Process according to claim 1 characterized in that the additive is constituted by water or an alcohol.

5. Process according to claim 1 characterized in that the pressure Pi and the temperature Ti are chosen so as to adjust the solvent power with respect to grease to a level sufficient to provide grease solubilization.

6. Process for the treatment of products constituted by skins or hides with a view to their transformation into leather, characterized in that it comprises the following stages:

a) contacting the skins or hides with a dense fluid containing at least one active substance for the transformation of the skins or hides, under a pressure Pi at least equal to the critical pressure Pc of the fluid and at a temperature Ti such that the fluid has an adequate density for impregnating the skins or hides with the active substance or substances and b) returning the skins or hides to atmospheric pressure in order to eliminate the dense fluid in gaseous form.

7. Process according to claim 6, characterized in that in stage a), there is a continuous circulation of the dense fluid containing the active substance or substances at the pressure Pi and the temperature Ti in a treatment enclosure containing the skins or hides, the dense fluid is treated on leaving the treatment enclosure in order to adjust its active substance content to a level sufficient for reuse and the thus treated, dense fluid is recycled to the treatment enclosure.

8. Process according to claim 6 characterized in that it also comprises a complementary rinsing stage of the skins or hides by means of a pure dense fluid, performed before stage a), before stage b) or before each of stages a) and b).

9. Process according to either of the claims 2 and 1 characterized in that in stage b), the continuous circulation of the dense, pressurized fluid is interrupted and the enclosure returned to atmospheric pressure.

10. Process according to either of the claims 1 and 6 characterized in that the dense fluid is selected from the group consisting of carbon dioxide, sulphur hexafluoride, nitrous oxide, ammonia and light alkanes.

11. Process according to claim 10, characterized in that the dense fluid is carbon dioxide.

12. Process according to either of claim 10, characterized in that the dense fluid is in the supercritical state.

13. Process according to claim 6 characterized in that the dense fluid also comprises an additive for modifying the solvent or dehydrating power of the dense fluid, or for facilitating the dissolving or transfer of the active substance or substances into the dense fluid.

14. Process according to claim 13, characterized in that the additive is constituted by water or an alcohol.

15. Process according to claim 6 characterized in that the active substance is selected from the group consisting of tanning agents, reinforcing agents, dyeing agents, waterproofing agents and precursors of said agents.

16. Process according to claim 6, characterized in that the active substance reacts with the products to be treated.

17. Process according to claim 6 characterized in that the active substance is converted into a form which is retained by the products to be treated.

18. Process according to claim 17 characterized in that the active substance is converted by a treatment selected from the group consisting of chemical, physicochemical, photochemical, irradiation and thermal treatments.

19. Process according to either of the claims 1 and 6, characterized in that during the contacting of the products to be treated with the dense fluid, the pressure of the dense fluid is periodically varied by $\Delta P$ around Pi.

20. Process according to claim 19, characterized in that the pressure variation $\Delta P$ represents 10% of Pi.

21. Process according to either of the claims 1 and 6, characterized in that the pressure Pi is from 6 to 50 mPa and the temperature Ti from 10° to 300° C.

22. Process according to claim 6 characterized in that the pressure Pi and the temperature Ti are chosen so as to adjust the solvent power with respect to grease or the dissolving capacity of the active substance or substances by the dense fluid to a level sufficient to provide grease solubilization or active substance dissolution.

23. Process according to claim 6 characterized in that the active substance is a telechelic oligomer selected from the group consisting of polyethylene glycols, polytetraethylene glycols and polymethylene glycols.

24. Process for the finishing of leather products, comprising the following stages:

a) contacting the leather with a dense fluid containing at least one active substance for the finishing of the leather selected from tanning agents, dyeing agents, waterproofing agents acrylate-diisocyanate condensation products, methylol-urea condensation products, methylol-melamine condensation products and precursors thereof, under a pressure Pi at least equal to the critical pressure Pc of the fluid and at a temperature Ti such that the fluid has an adequate density for impregnating the leather with the active substance or substances and b) returning the leather to atmospheric pressure in order to eliminate the dense fluid in gaseous form.

25. The process of claim 24, wherein said at least one active substance is a member selected from aldehyde tanning agents, acrylate-diisocyanate condensation products, methylol-urea condensation products, methylol-melamine condensation products, plant and vegetable tannins, metallic tannins having a metal selected from the group consisting of chromium, aluminum, zirconium, titanium and iron, nitro and nitroso compounds, monoazo dyes, polyazo dyes, metal complexes of azo dyes, stilbene compounds, diphenylmethane compounds, triphenylmethane compounds, oxazine compounds, thiazine compounds, azine compounds, pyridine, quinoline, acridine, phthalocyanin compounds, anthraquinone compounds, sulphur dyes, chromium complex waterproofing agents, fluorine fatty acids, chromium alkyl phosphates, aluminum alkyl phosphates, imidoacetic acid compounds, phosphoric acid esters, polysiloxane resins, fluorocarbon compounds and precursors thereof.

26. The process of claim 25, wherein said at least one active substance is a member selected from plant tannins, vegetable tannins, metallic tannins having a metal selected from the group consisting of chromium, aluminum, zirconium, titanium and iron, nitro and nitroso compounds, monoazo dyes, polyazo dyes, metal complexes of azo dyes, stilbene compounds, diphenylmethane compounds, triphenylmethane compounds, oxazine compounds, thiazine compounds, azine compounds, pyridine, quinoline, acridine, phthalocyanin compounds, anthraquinone compounds, sulphur dyes, chromium complex waterproofing agents, fluorine fatty acids, chromium alkyl phosphates, aluminum alkyl phosphates, imidoacetic acid compounds, phosphoric acid esters, fluorocarbon compounds and precursors thereof.

* * * * *

UNITED STATES PATENT AND TRADEMARK OFFICE

CERTIFICATE OF CORRECTION

PATENT NO. : 5,512,058

DATED : April 30, 1996

INVENTOR(S) : Gerard GAVEND, et al.

It is certified that error appears in the above-indentified patent and that said Letters Patent is hereby corrected as shown below:

On the title page, Item [54], and Col. 1, lines 1 thru 5, the title, should read:

--PROCESS FOR THE TREATMENT OF SKINS, HIDES OR SHEET MATERIALS CONTAINING COLLAGEN BY A DENSE, PRESSURIZED FLUID--

Signed and Sealed this

Thirteenth Day of August, 1996

Bruce Lehman

*Attest:*

BRUCE LEHMAN

*Attesting Officer*

*Commissioner of Patents and Trademarks*